US007938296B2

(12) United States Patent
Keller

(10) Patent No.: US 7,938,296 B2
(45) Date of Patent: May 10, 2011

(54) MULTICOMPONENT DISPENSING DEVICE WITH VALVE ASSEMBLY

(75) Inventor: Wilhelm A. Keller, Merlischachen (CH)

(73) Assignee: Medmix Systems AG, Rotkreuz (CH)

( * ) Notice: Subject to any disclaimer, the term of this patent is extended or adjusted under 35 U.S.C. 154(b) by 732 days.

(21) Appl. No.: 11/921,443

(22) PCT Filed: Jun. 15, 2006

(86) PCT No.: PCT/CH2006/000325

§ 371 (c)(1),
(2), (4) Date: Dec. 3, 2007

(87) PCT Pub. No.: WO2007/003063

PCT Pub. Date: Jan. 11, 2007

(65) Prior Publication Data

US 2009/0127289 A1 May 21, 2009

(30) Foreign Application Priority Data

Jul. 1, 2005 (CH) ..... 1113/05

(51) Int. Cl.
*B67D 5/52* (2006.01)

(52) U.S. Cl. ..... 222/145.5; 222/145.1; 222/135; 222/144.5

(58) Field of Classification Search ..... 222/135, 222/145.5, 145.1, 144.5, 386, 326, 137, 548; 366/172.1–173.1, 192, 193
See application file for complete search history.

(56) References Cited

U.S. PATENT DOCUMENTS

| | | | | |
|---|---|---|---|---|
| 43,154 | A * | 6/1864 | Heneage | 222/144.5 |
| 1,092,433 | A * | 4/1914 | Cox | 222/144.5 |
| 1,878,599 | A * | 9/1932 | Perkins | 222/506 |
| 4,432,469 | A * | 2/1984 | Eble et al. | 222/134 |
| 4,846,373 | A * | 7/1989 | Penn et al. | 222/137 |
| 4,989,758 | A * | 2/1991 | Keller | 222/137 |
| 5,009,342 | A * | 4/1991 | Lawrence et al. | 222/136 |
| 5,027,981 | A * | 7/1991 | Magister | 222/137 |
| 5,174,475 | A * | 12/1992 | Day et al. | 222/144.5 |
| 5,301,842 | A * | 4/1994 | Ritter | 222/137 |
| 5,370,275 | A * | 12/1994 | Mills et al. | 222/136 |
| 6,932,243 | B2 * | 8/2005 | Keller | 222/145.6 |
| 7,090,097 | B1 * | 8/2006 | Kazarian et al. | 222/144.5 |

FOREIGN PATENT DOCUMENTS

WO WO 2005/018830 A 3/2005

* cited by examiner

*Primary Examiner* — Kenneth Bomberg
*Assistant Examiner* — Donnell Long
(74) *Attorney, Agent, or Firm* — Foley & Lardner LLP

(57) ABSTRACT

A two-component syringe is provided with a valve assembly having a common inlet/outlet, the valve assembly being designed to selectively close the containers of the syringe or allow a liquid from the outside to be aspirated into one of the containers via the common inlet/outlet or connect the two containers to each other or allow a mixture to be dispensed through the common inlet/outlet. This valve assembly is composed of a valve body provided with a sealing disk having channels that are arranged such that the connections are established or interrupted when the valve body is rotated. The design of such a valve assembly is simple and cost-efficient, and it allows aspirating liquids into a container and transferring them to another container that holds a powder as well as dispensing multicomponent liquids or pastes efficiently and with minimum pressure and volume losses.

14 Claims, 3 Drawing Sheets

FIG. 6
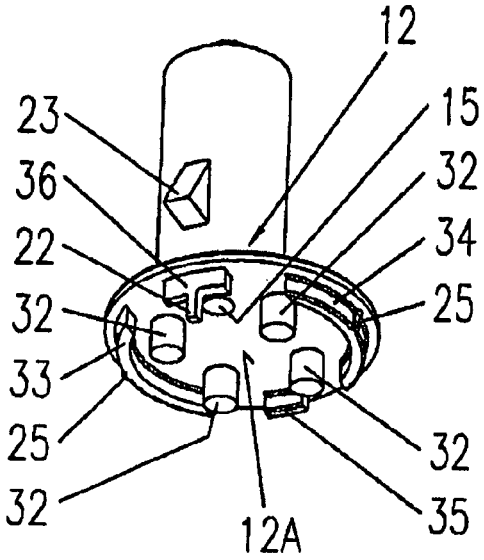
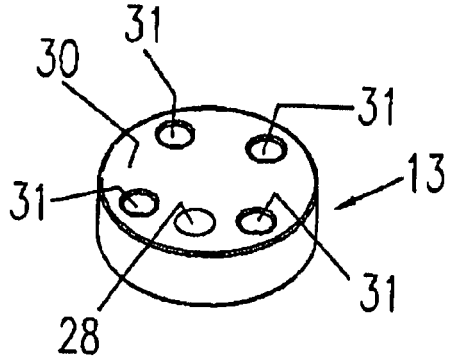
FIG. 7
FIG. 10
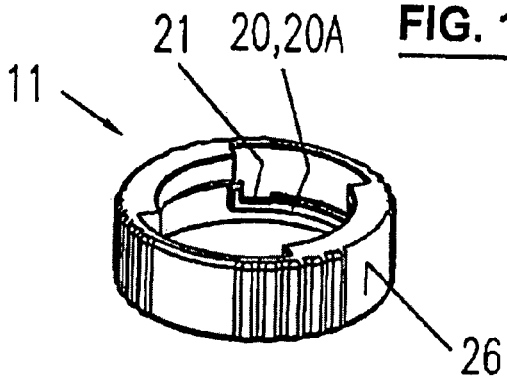
FIG. 8
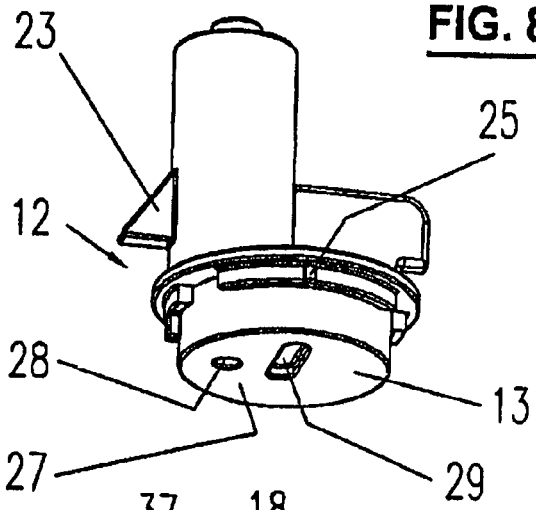
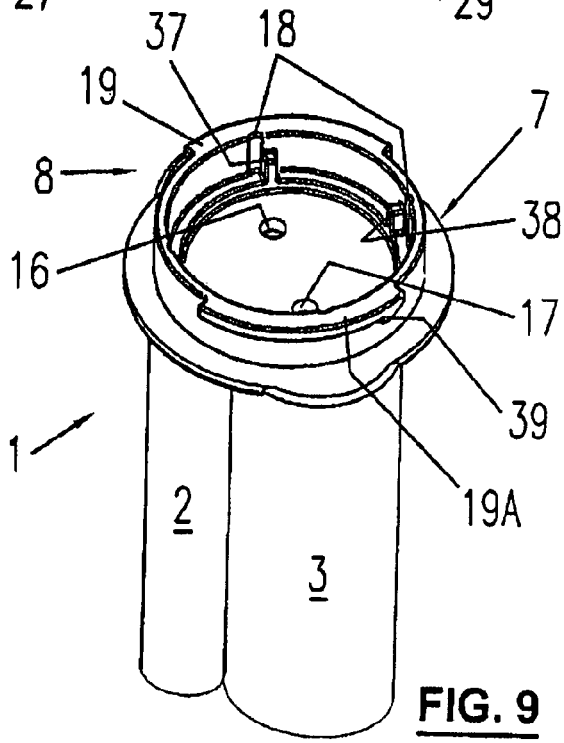
FIG. 9

MULTICOMPONENT DISPENSING DEVICE WITH VALVE ASSEMBLY

This is a national stage of PCT/CH2006/00325 filed Jun. 15, 2006, which claims priority to Switzerland application no. 1113/05 filed Jul. 1, 2005, the respective disclosures of which are hereby incorporated by reference in their entirety.

The present invention relates to a multicomponent dispensing device having at least two containers and a valve assembly with an inlet/outlet according to the preamble of claim 1. A device of this kind having a valve assembly is known from WO 2005/018830 to the applicant of the present invention.

Such a device with a valve assembly is particularly advantageous for a multicomponent syringe having a container for a liquid and a container for a powder where either the prefilled liquid is transferred to the powder for being mixed therewith and subsequently dispensed, or a liquid is aspirated from the exterior for being transferred, mixed with the powder, and subsequently dispensed. The four functions of closing, aspirating, transferring, and dispensing are provided by three-way valve assemblies.

Based on this prior art, it is the object of the present invention to provide a simpler and more effective valve assembly. This is accomplished by the valve assembly according to claim 1.

The invention will be explained in more detail hereinafter with reference to drawings of an exemplary embodiment.

Figure 1:
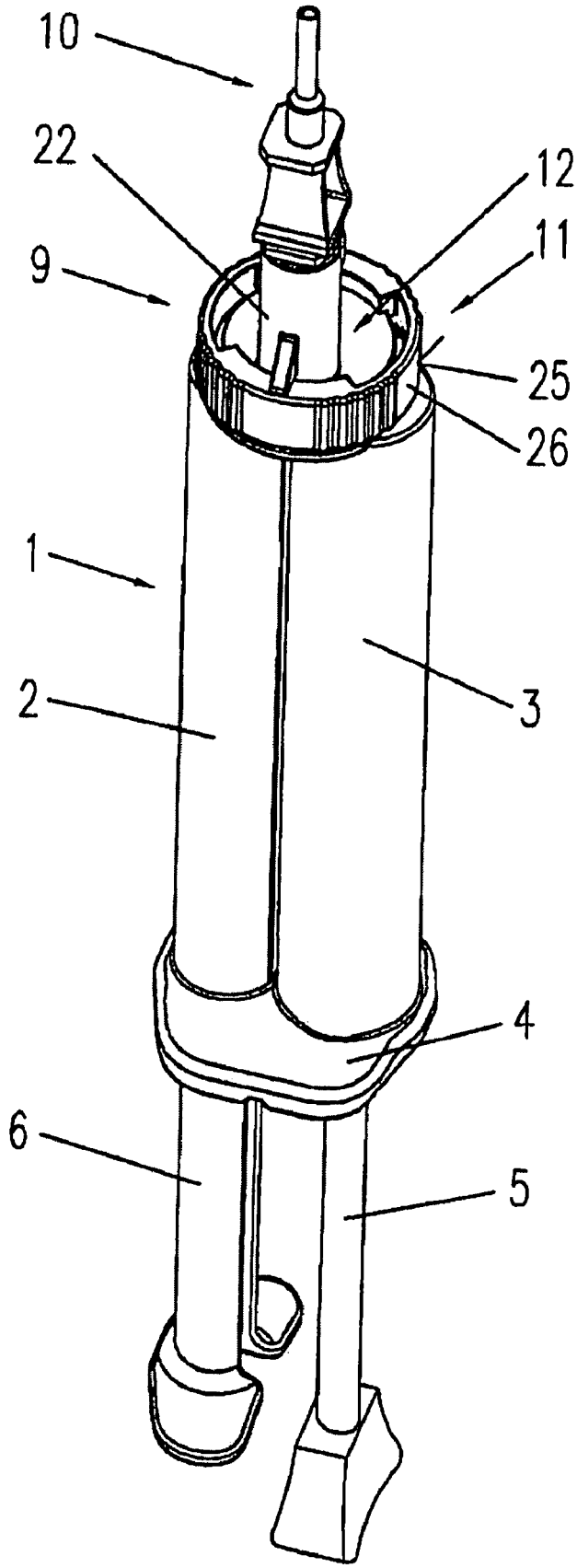

FIG. 1 shows a perspective view of a double syringe with a valve assembly according to the invention, FIGS. 2-5 show longitudinal sections of the valve assembly of FIG. 1 in different positions and the corresponding plan views, FIG. 6 shows the valve body of the valve assembly viewed from the side facing the containers, FIG. 7 shows a sealing disk viewed from the side facing the valve body, FIG. 8 shows the valve body of FIG. 6 with the sealing disk mounted thereon viewed from the side facing the containers, FIG. 9 shows a perspective view of the outlet side of the double syringe, and FIG. 10 shows a perspective view of a fastening ring.

Double syringe 1 according to FIG. 1 comprises two containers 2 and 3 and a retaining flange 4, the smaller container usually being intended to hold a liquid while the larger container 3 is intended to hold a powder. In analogy to the example according to FIG. 13 of WO 2005/018830, a mixing rod 5 extends into powder container 3 and a removable thrust rod 6 into liquid container 2, the mixing rod extending through the piston.

As disclosed in the anterior reference, the powder and liquid mixture can be stirred with the aid of the mixing rod and dispensed using thrust rod 6 of container 2. With regard to possible exemplary embodiments and applications of such double syringes or cartridges, reference is explicitly made to the cited document.

On the outlet side, valve assembly 9 according to the invention is arranged, on which a cannula or needle 10 is secured by means of a Luer-Lok connector. Instead of the Luer-Lok connector, another outlet configuration may be provided.

Valve assembly 9 is held down and fastened to double syringe 1 by means of a fastening ring 11. In the present exemplary embodiment, the fastening ring is in the form of a removable bayonet ring, but it may also be designed as a threaded ring or a snap ring or the valve assembly can be cemented or welded to the syringe.

In FIGS. 2 to 5, the components of valve assembly 9, i.e. valve body 12 and sealing disk 13, are shown assembled in the four positions. The plan views below each of them show the positions of the sealing disk in relation to the container outlets. The common inlet/outlet 15 is led through the valve body.

On the upper side of connecting flange 12A of valve body 12, a positioning nose 23 is arranged and on the opposite side a handle wing 24, the positioning nose and the handle wing facilitating the rotation and positioning of the valve body for the respective function. To this end, areas 26 are provided on the outside of the fastening ring which serve for receiving positioning marks, see FIG. 1.

FIG. 6 illustrates the details of valve body 12. On its side facing the containers, connecting flange 12A comprises four driving pins 32 that correspond to driving recesses 31 in the sealing disk. Furthermore, on the surface of the connecting flange facing the sealing disk, four guide segments 33, 34, 35 and 36 are arranged of which at least two are provided with cams 25 that cooperate with corresponding notches 18 in bayonet collar 8 of the double syringe. This provides corresponding snap-in positions for the valve body.

On the underside of the connecting flange, on guide segment 36, a stop 22 is arranged that cooperates with two stops 37 and 38 on the inner diameter of bayonet collar 8 and allows the valve to be rotated in the suitable direction only. Consequently, the closed, aspirating, transfer, and dispensing positions of the valve can be selected in this specific order only.

In FIGS. 7 and 8, sealing disk 13 is illustrated in detail. In FIG. 8, the surface 27 facing the containers is shown which comprises a passage 28 and a transfer channel 29. In addition to passage 28, the other side 30 shown in FIG. 7, which is turned towards the outlet respectively the valve body, comprises four driving recesses 31. The sealing disk is made from a softer material than the other plastic parts, e.g. from silicone or polyurethane, in order to fulfill its sealing function.

According to FIG. 9 outlets 16 of container 2 and 17 of container 3 of double syringe 1 are arranged in outlet flange 7. The outlet flange is provided with a bayonet collar 8 and the latter with bayonet tabs 19 and 19A that serve for receiving corresponding bayonet noses 20, 20A on fastening ring 11.

As appears in the drawings, for its assembly, the sealing disk is placed with its four fastening recesses 31 on driving pins 32 and pressed down and is positioned by the guide segments while through-going bore 28 is aligned with common inlet/outlet 15 of the valve body. The sealing disk is thus non-rotatably connected to the valve body.

The valve body is secured to outlet flange 7 of double syringe 1 by means of fastening ring 11, see FIG. 10, bayonet noses 20, 20A of the fastening ring engaging underneath bayonet tabs 19, 19A of bayonet collar 8 of the double syringe. In order to provide a secure, possibly non-detachable connection, the bayonet noses on the ring comprise snap means, e.g. in the form of a step 21, cooperating with corresponding cams 39 on the underside of the bayonet tabs.

By rotating the valve body and the sealing disk connected thereto, inlets/outlets 16 and 17 of containers 2 and 3 can be selectively closed, opened, connected to one another, or connected to inlet/outlet 15 in the valve body.

Figure 2:
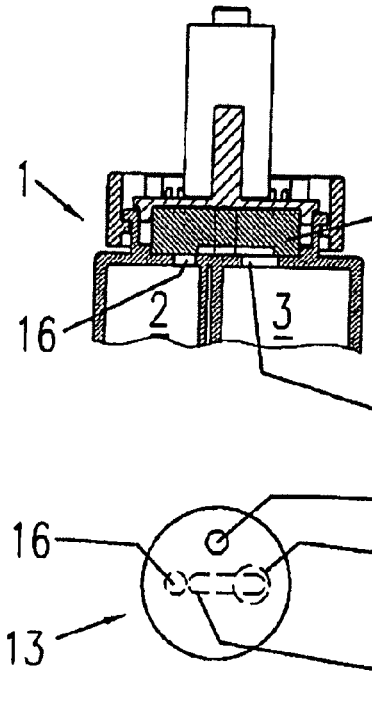

Herebelow, the four valve positions are explained with reference to FIGS. 2 to 5:

In FIG. 2, both container outlets 16 and 17 are closed. Transfer channel 29 is in a functionally neutral position.

Figure 3:
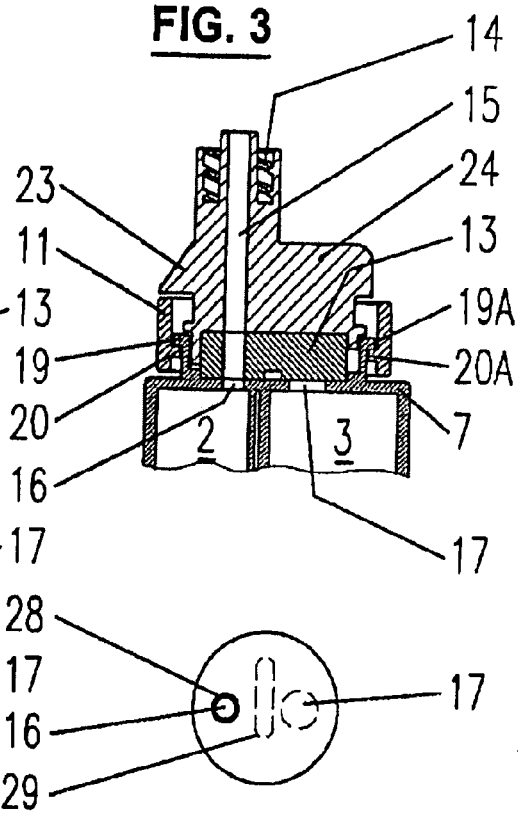

In FIG. 3, after a 90° rotation, liquid container 2 is connected to passage 28 of the sealing disk and to common inlet/outlet 15 of the valve body so that a liquid can be aspirated.

Figure 4:
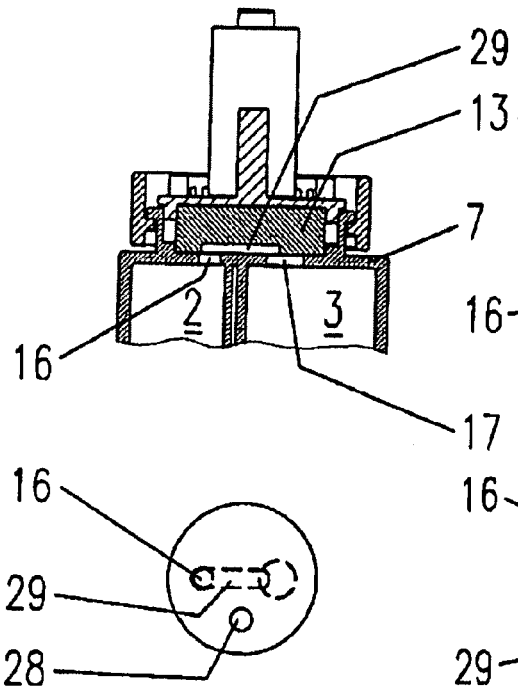

In FIG. 4, the valve body with the sealing disk is rotated 90° with respect to the position of FIG. 3 so that the two container outlets 16 and 17 are connected to each other via transfer channel 29 and the liquid can thus be transferred from container 2 to container 3.

Figure 5:
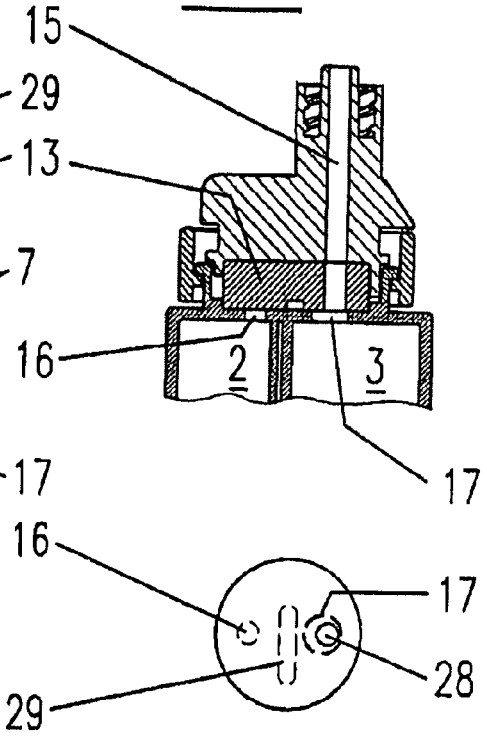

In FIG. 5, the valve body with the sealing disk is illustrated after another 90° rotation. Outlet 17 from container 3 is connected to passage 28 of sealing disk and to inlet/outlet 15 of the valve body so that the mixed components can be dispensed from container 3.

It is important in all aspirating respectively dispensing positions that the aspiration and chiefly the dispensing operation can take place in a straight line, without deviations or projecting edges, so that a minimum pressure loss results during these functions. Furthermore, the short transfer channel in the sealing disk ensures a minimum volume loss during the transfer of the liquid to container 3.

Although the present invention has been explained by means of a single exemplary embodiment having two containers, it is understood by those skilled in the art that the inventive idea is also applicable to other devices, e.g. to dispensing appliances with syringes or cartridges having more than two containers, as already disclosed in the publication that has been cited in the introduction. In a device having more than two containers, the valve assembly, particularly the sealing disk, must be correspondingly adapted.

In dispensing appliances having three containers arranged in a suitable configuration, e.g. a triangular one, it may be appropriate to use two sealing disks of which at least one is arranged at the valve body.

Furthermore, the valve assembly according to the invention may also be used for containers without a stirring device. Moreover, embodiments using a respective separate inlet and outlet in the valve body are possible in special cases for avoiding that liquid remaining in the common inlet/outlet during the aspirating operation may be dispensed before the mixed components and enter into the body.

The invention claimed is:

1. A dispensing device with a multicomponent syringe or cartridge, comprising:

at least two containers and a valve assembly having at least one common inlet/outlet, the valve assembly being designed, in at least four positions, to selectively connect the at least one common inlet/outlet to an outlet of a first container of the at least two containers or to an outlet of a second container of the at least two containers, or connect the outlet of the first container and the outlet of the second container to one another, or close the syringe or cartridge, wherein the valve assembly includes a valve body, having the at least one common inlet/outlet, and at least one sealing disk, of which at least one of the at least one sealing disk is arranged on the valve body, each of the at least one sealing disk having channels arranged such that the at least four positions are selectable by rotating the valve body.

2. A device according to claim 1, wherein each of the junctions between the at least one common inlet/outlet of the valve body and the outlets of the syringe or cartridge are arranged in a straight line.

3. A device according to claim 1, wherein the valve body and the sealing disk are removably or non-removably secured to the multicomponent dispensing device by a fastening ring.

4. A device according to claim 1, wherein the sealing disk is connected to the valve body by a driving element.

5. A device according to claim 1, wherein the sealing disk includes at least one passage and at least one transfer channel in order to selectively provide a connection between the first container and the common inlet/outlet, between the second container and the common inlet/outlet via one of the at least one passage, or between the first container and the second container via one of the at least one transfer channel or in order to close all container outlets.

6. A device according to claim 1, wherein the at least one sealing disk comprises a softer material than the remaining parts.

7. A device according to claim 1, wherein the syringe or cartridge includes an outlet flange in which the container outlets are arranged as openings and which is provided with fastening elements for a fastening ring.

8. A device according to claim 7, wherein the fastening elements on the outlet flange and on the fastening ring include cooperating snap locking elements.

9. A device according to claim 8, wherein the valve body includes a connecting flange whose surface facing the at least one common inlet/outlet includes a positioning nose cooperating with an indicator element on the fastening ring and a handle wing.

10. A device according to claim 8, wherein a side, facing the containers, of the connecting flange includes driving pins and guide segments configured to receive the at least one sealing disk.

11. A device according to claim 10, wherein the guide segments include snap cams and a stop.

12. A device according to claim 7, wherein the fastening elements for the fastening ring on the double syringe or cartridge comprise bayonet-type fastening elements.

13. A device according to claim 1, with a double syringe, wherein the first container, for a liquid, includes a thrust rod that is configured to be removed from a first piston, and wherein the second container, for a powder, includes a mixing rod that is configured to extend through a second piston.

14. A device according to claim 6, wherein the sealing disk comprises silicone or polyurethane.

* * * * *